US008939262B2

(12) United States Patent
Schienda et al.

(10) Patent No.: US 8,939,262 B2
(45) Date of Patent: Jan. 27, 2015

(54) ELEVATOR OVER-ACCELERATION AND OVER-SPEED PROTECTION SYSTEM

(75) Inventors: Greg A. Schienda, Plantsville, CT (US); Daryl J. Marvin, Farmington, CT (US); Harold Terry, Avon, CT (US); James M. Draper, East Hartland, CT (US); Anthony Cooney, Unionville, CT (US); Jose M. Carballo, Tampa, FL (US)

(73) Assignee: Otis Elevator Company, Farmington, CT (US)

( * ) Notice: Subject to any disclaimer, the term of this patent is extended or adjusted under 35 U.S.C. 154(b) by 706 days.

(21) Appl. No.: 13/256,886

(22) PCT Filed: Mar. 16, 2009

(86) PCT No.: PCT/US2009/001646

§ 371 (c)(1),
(2), (4) Date: Sep. 15, 2011

(87) PCT Pub. No.: WO2010/107407

PCT Pub. Date: Sep. 23, 2010

(65) Prior Publication Data

US 2012/0000731 A1 Jan. 5, 2012

(51) Int. Cl.
*B66B 5/06* (2006.01)

(52) U.S. Cl.
CPC ..... *B66B 5/06* (2013.01)
USPC ..... 187/287; 187/391

(58) Field of Classification Search
USPC ..... 187/247, 288, 289, 391–393, 287
See application file for complete search history.

(56) References Cited

U.S. PATENT DOCUMENTS

| | | | | |
|---|---|---|---|---|
| 5,366,044 | A | 11/1994 | Jamieson et al. | |
| 5,869,794 | A | 2/1999 | Spiess | |
| 6,161,653 | A | 12/2000 | Skalski et al. | |
| 6,173,813 | B1 | 1/2001 | Rebillard et al. | |
| 6,253,879 | B1 | 7/2001 | Skalski et al. | |
| 7,228,943 | B2 * | 6/2007 | Kugiya et al. | 187/393 |
| 7,267,201 | B2 | 9/2007 | Ito | |
| 7,344,003 | B2 * | 3/2008 | Kimura et al. | 187/256 |
| 7,353,916 | B2 * | 4/2008 | Angst | 187/393 |

(Continued)

FOREIGN PATENT DOCUMENTS

| | | |
|---|---|---|
| CN | 1860077 A | 11/2006 |
| EP | 1369372 A1 | 12/2003 |

(Continued)

OTHER PUBLICATIONS

State Intellectual Property Office, P.R. China, First Office Action, Feb. 20, 2013, 5 pages.

(Continued)

*Primary Examiner* — Anthony Salata
(74) *Attorney, Agent, or Firm* — Cantor Colburn LLP

(57) ABSTRACT

An elevator system includes an electronic system capable of triggering a machine room brake and an electromagnetic safety trigger with low hysteresis and with minimal power requirements that can be released to engage safeties, when car over-speed and/or over-acceleration is detected. The electromagnetic trigger may be reset automatically and may be released to engage the safeties, during the reset procedure. The system includes a processing system that is configured to decrease response time and to reduce the occurrence of false triggers caused by conditions unrelated to passenger safety, such as passengers jumping inside the elevator car.

21 Claims, 7 Drawing Sheets

(56) References Cited

U.S. PATENT DOCUMENTS

| | | | | |
|---|---|---|---|---|
| 7,533,763 | B2 * | 5/2009 | Kattainen et al. | 187/394 |
| 7,721,852 | B2 * | 5/2010 | Ishioka et al. | 187/391 |
| 7,729,806 | B2 * | 6/2010 | Ohira | 700/275 |
| 7,849,972 | B2 * | 12/2010 | Higashinaka | 187/351 |
| 8,297,413 | B2 * | 10/2012 | Kigawa et al. | 187/393 |
| 8,631,909 | B2 * | 1/2014 | Draper et al. | 187/373 |
| 2004/0079591 | A1 | 4/2004 | Mueller | |
| 2007/0089938 | A1 | 4/2007 | Ishioka et al. | |
| 2008/0017456 | A1 | 1/2008 | Ito | |
| 2008/0060882 | A1 | 3/2008 | Nuebling | |
| 2012/0000729 | A1 * | 1/2012 | Marvin et al. | 187/287 |
| 2012/0000732 | A1 * | 1/2012 | Draper et al. | 187/373 |

FOREIGN PATENT DOCUMENTS

| | | | |
|---|---|---|---|
| EP | 1604935 | A1 | 12/2005 |
| EP | 1780160 | A1 | 5/2007 |
| EP | 1864934 | A1 | 12/2007 |
| JP | 2004010177 | A | 1/2004 |
| JP | 2007521203 | A | 8/2007 |
| JP | 2009023823 | A | 2/2009 |
| KR | 20040029816 | A | 4/2004 |
| WO | 0037348 | | 6/2000 |
| WO | 0039016 | | 7/2000 |
| WO | 03091142 | A1 | 11/2003 |
| WO | 2004083091 | A1 | 9/2004 |
| WO | 2005044709 | A1 | 5/2005 |
| WO | 2008057116 | A1 | 5/2008 |

OTHER PUBLICATIONS

Japanese Patent Office, Office Action, May 21, 2013, 5 pages.
Korean Patent Office, Office Action, Oct. 15, 2012, 5 pages.
Patent Cooperation Treaty, International Searching Authority, International Search Report and Written Opinion, Dec. 18, 2009, 10 pages.

* cited by examiner

ELEVATOR OVER-ACCELERATION AND OVER-SPEED PROTECTION SYSTEM

BACKGROUND

The present invention relates generally to an electronic over-acceleration and over-speed protection system for an elevator.

Elevators include a safety system to stop an elevator from traveling at excessive speeds in response to an elevator component breaking or otherwise becoming inoperative. Traditionally, elevator safety systems include a mechanical speed sensing device typically referred to as a governor and safeties or clamping mechanisms that are mounted to the elevator car frame for selectively gripping elevator guide rails. If the hoist ropes break or other elevator operational components fail, causing the elevator car to travel at an excessive speed, the governor triggers the safeties to slow or stop the car.

The safeties include brake pads that are mounted for movement with the governor rope and brake housings that are mounted for movement with the elevator car. The brake housings are wedge shaped, such that as the brake pads are moved in a direction opposite from the brake housings, the brake pads are forced into frictional contact with the guide rails. Eventually the brake pads become wedged between the guide rails and the brake housing such that there is no relative movement between the elevator car and the guide rails. To reset the safety system, the brake housing (i.e., the elevator car) must be moved upward while the governor rope is simultaneously released.

One disadvantage with this traditional safety system is that the installation of the governor, including governor and tensioning sheaves and governor rope, is very time consuming. Another disadvantage is the significant number of components that are required to effectively operate the system. The governor sheave assembly, governor rope, and tension sheave assembly are costly and take up a significant amount of space within the hoistway, pit, and machine room. Also, the operation of the governor rope and sheave assemblies generates a significant amount of noise, which is undesirable. Further, the high number of components and moving parts increases maintenance costs. Finally, in addition to being inconvenient, manually resetting the governor and safeties can be time consuming and costly. These disadvantages have an even greater impact in modern high-speed elevators.

SUMMARY

An elevator safety system includes a speed detector, an acceleration detector, a mechanical safety, an electromagnetic trigger, and a controller. The speed detector monitors a speed of an elevator system mass including, for example, a car or a counterweight. The acceleration detector monitors an acceleration of the mass. The safety is connected to the mass, and the electromagnetic trigger is connected to the safety. The controller releases the trigger to engage the safety when the speed detector signals an over-speed condition or the acceleration detector signals an over-acceleration condition. The controller also automatically resets the trigger.

DETAILED DESCRIPTION

Figure 1:
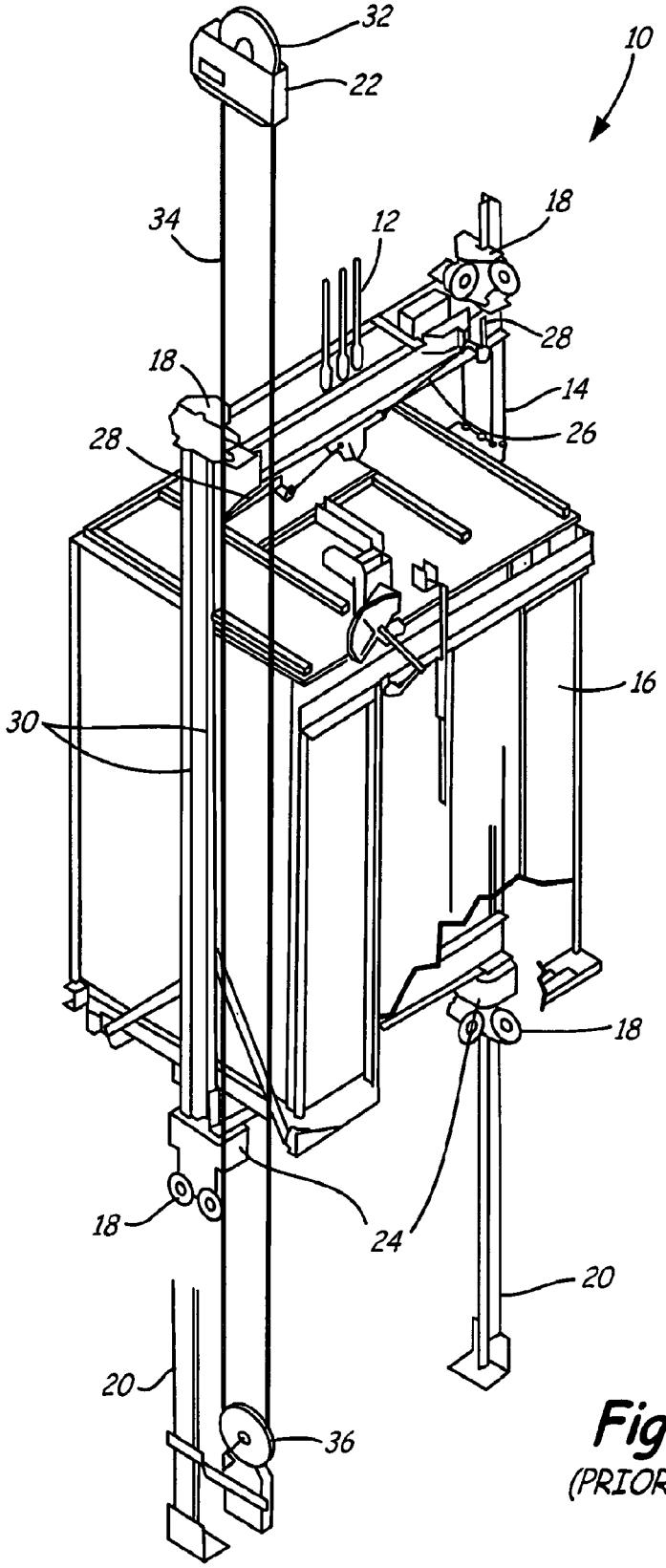
Fig. 1 (PRIOR ART)
FIG. 1 shows a prior art elevator system employing a mechanical governor.

FIG. 1 shows prior art elevator system 10, which includes cables 12, car frame 14, car 16, roller guides 18, guide rails 20, governor 22, safeties 24, linkages 26, levers 28, and lift rods 30. Governor 22 includes governor sheave 32, rope loop 34, and tensioning sheave 36. Cables 12 are connected to car frame 14 and a counterweight (not shown in FIG. 1) inside a hoistway. Car 16, which is attached to car frame 14, moves up and down the hoistway by force transmitted through cables 12 to car frame 14 by an elevator drive (not shown) commonly located in the machine room at the top of the hoistway. Roller guides 18 are attached to car frame 14 and guide car frame 14 and car 16 up and down the hoistway along guide rails 20. Governor sheave 32 is mounted at an upper end of the hoistway. Rope loop 34 is wrapped partially around governor sheave 32 and partially around tensioning sheave 36 (located in this embodiment at a bottom end of the hoistway). Rope loop 34 is also connected to elevator car 16 at lever 28, ensuring that the angular velocity of governor sheave 32 is directly related to the speed of elevator car 16.

In elevator system 10 as shown in FIG. 1, governor 22, an electromechanical brake (not shown) located in the machine room, and safeties 24 act to stop elevator car 16 if car 16 exceeds a set speed as it travels inside the hoistway. If car 16 reaches an over-speed condition, governor 22 is triggered initially to engage a switch, which in turn cuts power to the elevator drive and drops the brake to arrest movement of the drive sheave and thereby arrest movement of car 16. If, however, cables 12 break or car 16 otherwise experiences a free-fall condition unaffected by the brake, governor 22 may then act to trigger safeties 24 to arrest movement of car 16. In addition to engaging a switch to drop the brake, governor 22 also releases a clutching device that grips the governor rope 34. Governor rope 34 is connected to safeties 24 through mechanical linkages 26, levers 28, and lift rods 30. As car 16 continues its descent unaffected by the brake, governor rope 34, which is now prevented from moving by actuated governor 22, pulls on operating lever 28. Operating lever 28 "sets" safeties 24 by moving linkages 26 connected to lift rods 30, which lift rods 30 cause safeties 24 to engage guide rails 20 to bring car 16 to a stop.

As described above, there are many disadvantages to traditional elevator safety systems including mechanical governors. Embodiments of the present invention therefore include an electronic system capable of triggering the machine room brake and releasing an electromagnetic safety trigger with low hysteresis and with minimal power requirements to engage the safeties when particular car over-speed and/or over-acceleration conditions are detected. The electromagnetic trigger may be reset automatically and may be released to engage the safeties during the reset procedure. An over-speed and over-acceleration detection and processing system is configured to decrease response time and to reduce the occurrence of false triggers caused by conditions unrelated to passenger safety, such as passengers jumping inside the elevator car.

Elevator Over-Acceleration and Over-Speed Protection System

Figure 2:
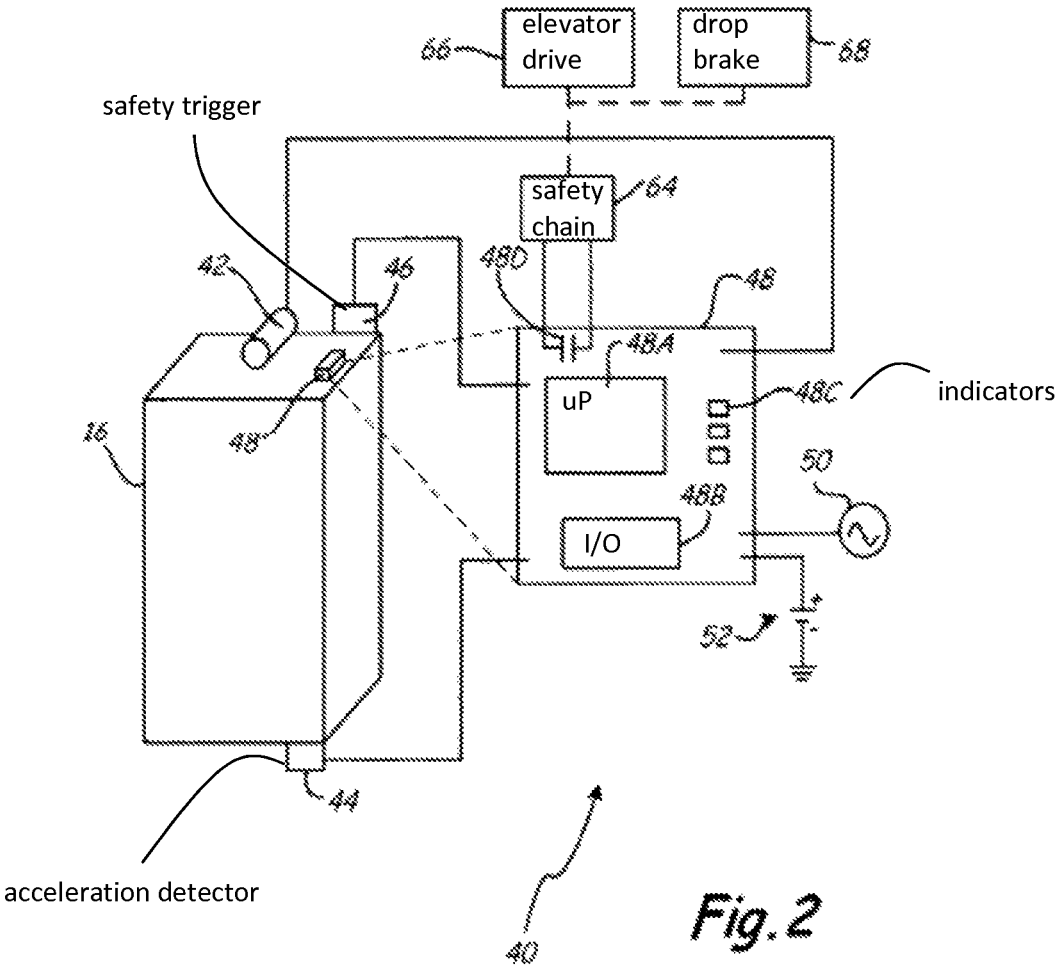
FIG. 2 is a schematic of an elevator system according to the present invention that includes an electronic over-speed and over-acceleration protection system.

FIG. 2 is a schematic of elevator system 40 according to the present invention including car 16, speed detector 42, acceleration detector 44, electromagnetic safety trigger 46, and controller 48. Speed detector 42 is an electromechanical device configured to measure the speed of car 16 as it travels inside the hoistway during operation of elevator system 40 and to electronically communicate with controller 48. For example, speed detector 42 may be a tachometer, which is also referred to as a generator. Generally speaking, a tachometer is a device that measures the speed of a rotating component in, for example, revolutions per minute (RPM). In embodiments of the present invention, the tachometer will either electronically measure the mechanical rotation or will translate a mechanical measurement into electronic signals for interpretation by controller 48.

Acceleration detector 44 may be an electronic device that is configured to measure the acceleration of the car 16. Acceleration detector 44 may be, for example, an accelerometer. One type of accelerometer that may be used is a micro electromechanical system (MEMS) that commonly consists of a cantilever beam with a proof mass (also known as seismic mass). Under the influence of acceleration, the proof mass deflects from its neutral position. The deflection of the proof mass may be measured by analog or digital methods. For example, the variation in capacitance between a set of fixed beams and a set of beams attached to the proof mass may be measured.

Controller 48 may be, for example, a circuit board including microprocessor 48A, input/output (I/O) interface 48B, indicators 48C (which may be, for example, light emitting diodes), and safety chain switch 48D. Controller 48 is powered by power source 50 with battery backup 52.

As shown in FIG. 2, speed detector 42, acceleration detector 44, electromagnetic safety trigger 46, and controller 48 are all connected to car 16. In FIG. 2, speed detector 42 is mounted to the top of car 16, and acceleration detector 44 may be mounted on a circuit board of controller 48. In alternative embodiments, speed detector 42 and acceleration detector 44 may be mounted to car 16 in various locations that are appropriate for making speed/acceleration measurements. Controller 48 is configured to receive and interpret signals from the speed detector 42 and acceleration detector 44, and to control electromagnetic safety trigger 46.

Figure 3A:
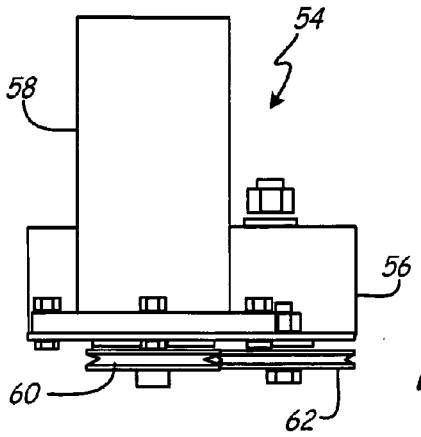
FIGS. 3A-3C show a tachometer appropriate for in the electronic over-speed and over-acceleration protection system shown in FIG. 2.
Figure 3B:
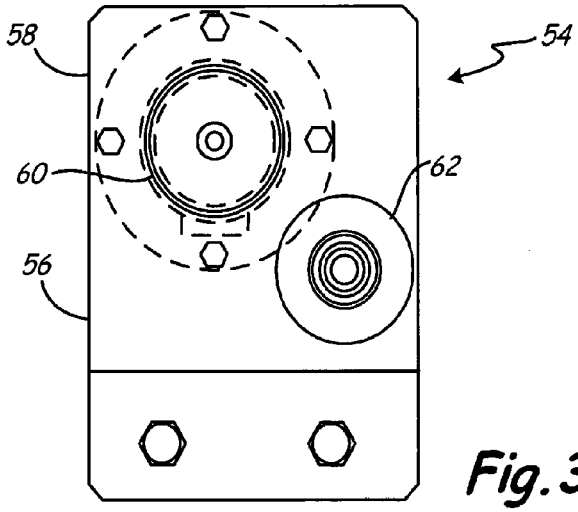
Figure 3C:
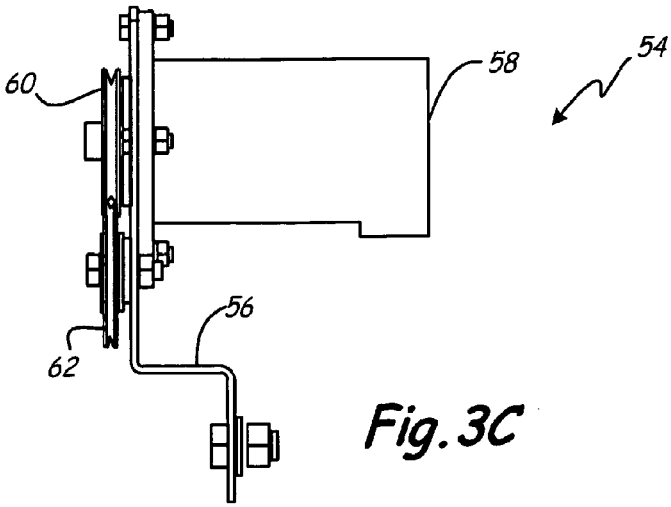

In embodiments where speed detector 42 is a tachometer, the tachometer may be mounted to an idler sheave on top of car 16. The idler sheave will rotate at a speed related to the speed of car 16. The tachometer may therefore be configured to measure the speed of the car indirectly by measuring the speed at which the idler sheave rotates. In an alternative embodiment employing a tachometer, for example, in an elevator system with a 1:1 roping arrangement that does not include an idler sheave on the car, a static rope may be suspended in the hoistway adjacent to car 16 and the tachometer may be connected to the rope. For example, FIGS. 3A-3C show tachometer 54 including mounting bracket 56, electrical generator 58, drive sheave 60, and tensioning sheave 62. FIG. 3A is a plan view of tachometer 54. FIGS. 3B and 3C are elevation front and side views of tachometer 54 respectively. Tachometer 54 may be connected to car 16 by mounting bracket 56. Generator 58, drive sheave 60, and tensioning sheave 62 are all connected to mounting bracket 56. Drive sheave 60 is rotatably connected to generator 58. A static rope suspended in the hoistway may run up from the bottom of the hoistway and wrap partially over the top of tensioning sheave 62, under drive sheave 60 and up toward the top of the hoistway. As car 16 moves up and down the hoistway, the action of the static rope on tachometer 54 will rotate drive sheave 60, which in turn will drive generator 58. The output of generator is a function of the speed at which generator is driven, and may be measured to provide an indication of speed of car 16. In yet another embodiment, a tachometer may be driven by engaging the stationary guide rails along which car 16 is guided up and down the hoistway.

Controller 48 receives inputs from speed detector 42 and acceleration detector 44, and provides an output electromagnetic safety trigger 46. Controller 48 also includes safety chain switch 48D, which forms a part of safety chain 64 of elevator system 40. Safety chain 64 is a series of electromechanical devices distributed inside the hoistway and connected to the elevator drive and brake in the machine room.

Electromagnetic safety trigger 46 is arranged on car 16 to be connected to the car safeties, which, for clarity, are not shown in FIG. 2 but which may be arranged and function similar to safeties 24 described with reference to FIG. 1. FIG. 1 shows safeties 24 arranged toward the bottom of car 16, and electromagnetic safety trigger 46 may also be mounted on the bottom of car 16. Alternative embodiments may include elevator systems with safeties and electromagnetic safety trigger 46 arranged toward the top of the car.

During operation of elevator system 40, speed detector 42 and acceleration detector 44 sense the speed and acceleration of car 16 traveling inside the hoistway. Controller 48 receives signals from speed detector 42 and acceleration detector 44, and interprets the information to determine if an unsafe over-speed and/or over-acceleration condition has occurred. In the event car 16 experiences an unsafe over-speed and/or over-acceleration condition, controller 48 first opens safety chain switch 48D to safety chain 64 of elevator system 40. Opening switch 48D breaks safety chain 64 to interrupt power to the elevator drive 66 (typically located in the machine room at the upper end of the hoistway) and activate or drop brake 68 on the drive sheave of elevator drive 66. In the event that movement of car 16 is unaffected by dropping the machine room brake 68 (for example, if cables 12 connected to car 16 fail), the over-speed or over-acceleration condition continues to be sensed, and controller 48 releases electromagnetic safety trigger 46. Releasing safety trigger 46 causes the elevator safeties, including, for example, safeties 24 shown in FIG. 1, to be engaged to slow or stop car 16. Embodiments of electromagnetic safety triggers and over-speed and over-acceleration detection and processing systems according to the present invention will now be shown and described in greater detail.

Electromagnetic Elevator Safety Trigger

Figure 4A:
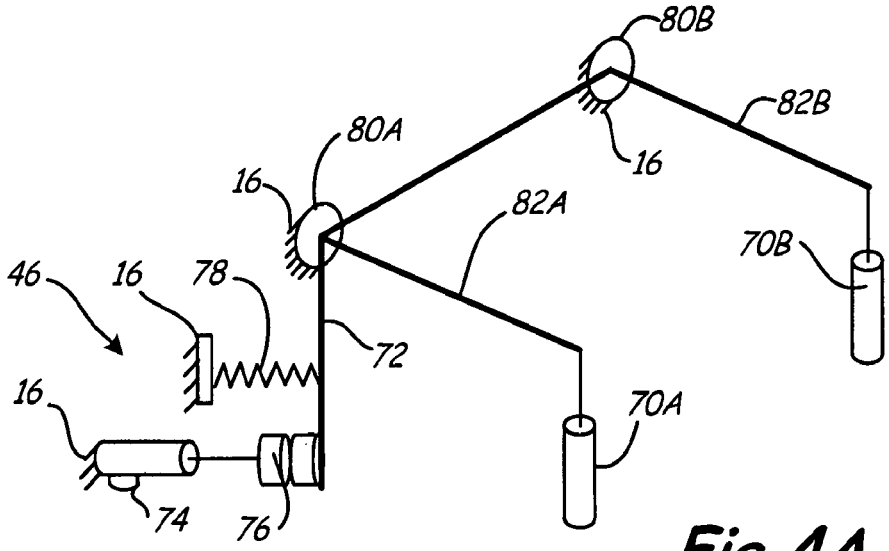
FIGS. 4A and 4B are schematic illustrations of an electromagnetic safety trigger that is employed in an elevator system.
Figure 4B:
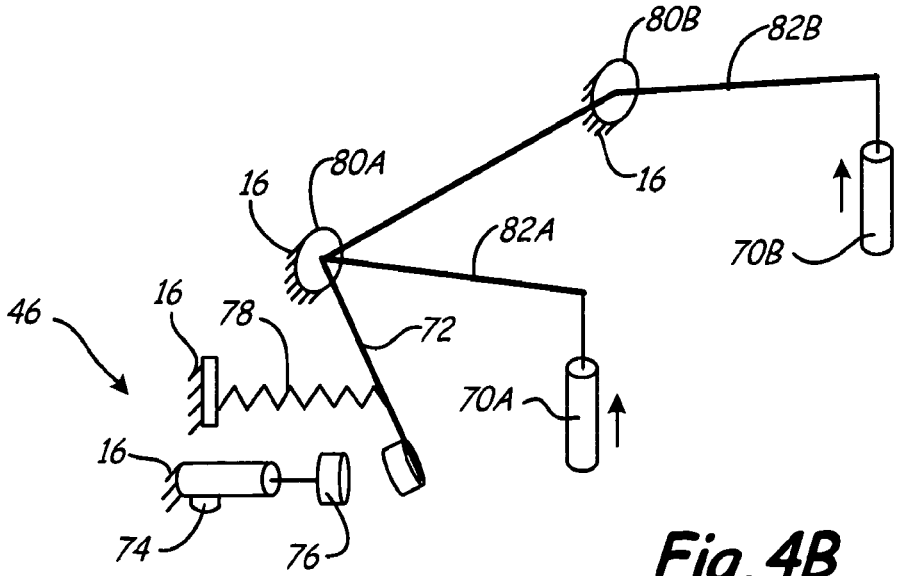

FIGS. 4A and 4B are schematic illustrations of electromagnetic safety trigger 46 according to the present invention employed in an elevator system including safeties 70A and 70B. Safety trigger 46 includes link 72, linear actuator 74, electromagnet 76, and spring 78. FIG. 4A shows trigger 46 in a ready state waiting to be released to engage safeties 70A, 70B. FIG. 4B shows trigger 46 released to engage safeties 70A, 70B. For simplicity, not all of the components of the elevator system are shown in FIGS. 4A and 4B. However, as described above, the components of trigger 46 and safeties 70A, 70B will, generally speaking, be mounted to the elevator system mass against which they are guarding unsafe conditions including, for example, a car or a counterweight. Safeties 70A, 70B may be similar in arrangement and configuration to safeties 24 shown in FIG. 1, or may be any other safety device capable of being mechanically engaged by trigger 46 and of slowing or stopping an elevator system mass in an unsafe over-speed and/or over-acceleration condition.

In FIGS. 4A and 4B, link 72 is kinematically connected to safeties 70A, 70B by pivot points 80A, 80B and safety lift rods 82A, 82B, respectively. In alternative embodiments, link 72 may be connected to safeties 70A, 70B by simpler or more complex kinematic mechanisms in any arrangement that causes safeties 70A, 70B to be engaged when link 72 is moved. Additionally, there may be more than one electromagnetic safety trigger 46 employed in the elevator system. For example, instead of one trigger 46 engaging both safeties 70A, 70B as shown in FIGS. 4A and 4B, alternative embodiments may include a trigger 46 for each safety 70. Linear actuator 74 is connected to one side of elevator car 16. Electromagnet 76 is connected to linear actuator 74 and magnetically connected to link 72. Spring 78 is connected between link 72 and car 16.

During elevator operation, electromagnetic safety trigger 46 is operable to engage safeties 70, 70B in the event an unsafe over-speed or over-acceleration condition is detected for car 16. As illustrated in FIG. 4B, trigger 46 is configured to break the magnetic connection between electromagnet 76 and link 72 by actuating electromagnet 76 when an over-speed or over-acceleration condition occurs. When electromagnet 76 is actuated, link 72 is allowed to move away from electromagnetic 76, which releases the energy stored in compressed spring 78 to cause spring 78 to decompress. Decompressing spring 78, in turn, moves link 72 to raise lift rods 82A, 82B and thereby engage safeties 70A, 70B to slow or stop car 16.

After the safety condition for car 16 has been resolved, trigger 46 may be automatically reset. Linear actuator 74 is configured to extend to position electromagnet 76 to grab link 72, i.e. reestablish the magnetic connection, after link 72 has moved to engage safeties 70, 70B. Linear actuator 74 may then retract electromagnet 76, which is magnetically connected to link 72 to compress spring 78 and disengage safeties 70, 70B. Finally, trigger 46 may engage safeties 70, 70B during a reset operation by causing electromagnet 76 to release link 72 while linear actuator 74 is retracting.

Figure 5:
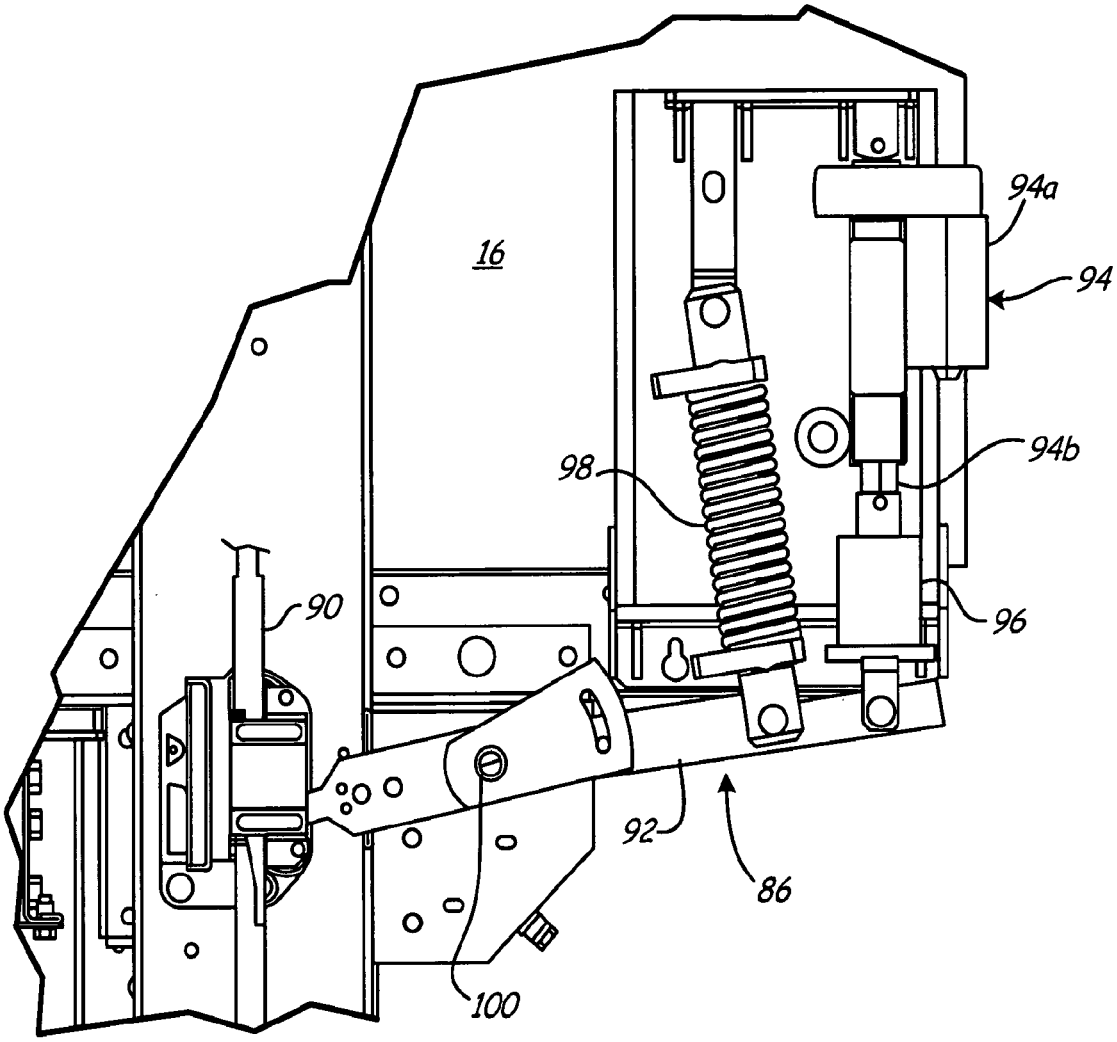
FIG. 5 is a broken plan view showing one implementation of an electromagnetic safety trigger that is mounted on an elevator car.

FIG. 5 is a broken plane view showing one implementation of electromagnetic safety trigger 86 according to the present invention mounted toward the bottom of elevator car 16 adjacent safety lift rod 90. Trigger 86 includes link 92, linear actuator 94, electromagnet 96, and coil spring 98. In FIG. 5, one end of link 92 is connected to lift rod 90. The opposite end of link 92 is connected to coil spring 98 and magnetically connected to electromagnet 96. Between the two ends, link 92 is pivotally connected to car 88 at pivot point 100. Linear actuator 94 is connected to electromagnet 96. Coil spring 98 is connected to car 88. Trigger 86 is shown in a ready state with coil spring 98 fully compressed and electromagnet 96 magnetically connected to link 92.

Electromagnet 96 is configured to be magnetized when in a de-energized state and demagnetized when in an energized state. Therefore, during normal safe operation of car 88, electromagnet 96 holds link 92 and compressed coil spring 98 without the need for a continuous supply of electricity. When an unsafe over-speed or over-acceleration condition is detected, trigger 86 may be released to engage the safety connected to lift rod 90 by sending an electrical pulse to electromagnet 96 to defeat the magnetic connection to link 92, thereby releasing the energy stored in compressed spring 98 to cause spring 98 to decompress. Decompressing spring 98, in turn, moves link 92 to move lift rod 90 and thereby engage the safety to slow or stop car 88.

Linear actuator 94 is an electrical actuator including electric motor 94*a* operably connected to drive shaft 94*b*. Motor 94*a* may employ, for example, a ball screw or worm screw drive system to translate the rotational motion of motor 94*a* into linear motion of shaft 94*b*. In any case, motor 94*a* may be non-backdrivable to make trigger 86 more energy efficient and less complex. Non-backdrivable actuators may be set to a particular position, e.g. the extension or retraction position of shaft 94*b*, and held there without supplying the actuator with a continuous supply of electricity. Drive shaft 94*b* will only move during a reset operation, first to connect to electromagnet 96, and then to move the safety mechanism back to its reset location.

Although trigger 86 shown in FIG. 5 employs coil spring 98, alternative embodiments may include different mechanical springs or other resilient members. For example, trigger 86 could employ a torsion spring connected to link 92 at pivot point 100. The torsion spring could be set to be held in compression when actuator 94 is retracted and electromagnet 96 is magnetically connected to link 92.

Over-Acceleration and Over-Speed Detection and Processing System

Generally speaking, elevator systems are designed to detect and engage the elevator safeties under runaway and free fall conditions. A runaway condition is when the elevator machine room brakes fail to hold the car as it travels in either direction generating a threshold maximum acceleration. A free fall condition is an elevator traveling down at 1 g. Activation of the safeties commonly means that disengaging the drive system and dropping the machine room brake has failed or is expected to fail to stop the elevator car from traveling at unsafe speeds and/or accelerations.

Elevator codes specify the maximum speed at which the safeties are required to apply a stopping force to the elevator. Some jurisdictions also specify two speed settings, one to drop the brake and disengage the drive system and one to apply the safeties.

Passengers in elevators can create disturbances over a short period of time that will make the system appear to be over-speeding and/or over-accelerating. Elevator safety devices should not react to these disturbances. Examples of passenger disturbances that do not create unsafe conditions include jumping in the car or bouncing causing the car to oscillate. A passenger can cause, for example, a 2 to 4 hertz oscillation with a 0.4 m/s (1.3 ft/s) amplitude. The safeties should also not be falsely engaged under emergency braking or buffer strikes. Speed signals are usually obtained by some form of traction encoder or transducer including, for example, the tachometer arrangements described above. These devices are subject to momentary false readings due to traction loss. Embodiments of over-acceleration and over-speed detection and processing systems according to the present invention detect elevator system runaway and free fall conditions by distinguishing between over-acceleration and over-speed caused by conditions unrelated to passenger safety and over-acceleration and over-speed caused by unsafe conditions. Upon detecting an actual runaway and/or free fall condition, the systems electronically activate the machine room brake and, where appropriate, trigger the safeties.

Over-acceleration and over-speed detection and processing systems include an electromechanical speed detector and an acceleration detector connected and configured to send signals to a controller as described with reference to and shown in FIG. 2. The controller may include a microprocessor and associated circuitry. Speed and acceleration detection and processing algorithm(s) included in the system can be implemented in embedded software or may be stored in memory for use by the microprocessor. On board memory may include, for example, flash memory.

Figure 6:
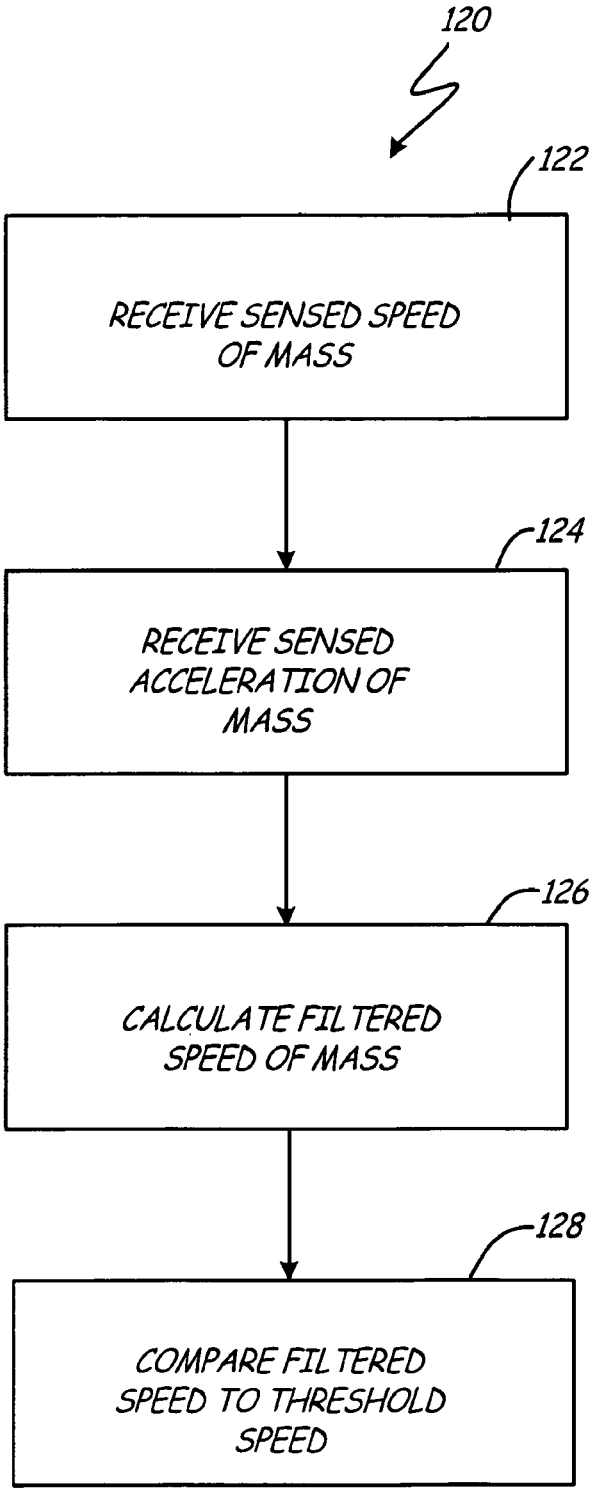
FIG. 6 is a flow chart of a method according to the present invention for detecting and processing over-acceleration and over-speed conditions for an elevator system mass.

FIG. 6 is a flow chart of method 120 according to the present invention for detecting and processing over-acceleration and over-speed conditions for an elevator system mass (e.g. a car or counterweight). As described above, method 120 may be implemented as one or more software or hardware based algorithms carried out by a controller. Method 120 includes receiving a sensed speed of the mass from a speed detector (step 122) and receiving a sensed acceleration of the mass from an acceleration detector (step 124). A filtered speed of the mass is calculated as a function of the sensed speed and the sensed acceleration (step 126). The filtered speed is compared to a threshold speed to determine if the mass has reached an over-speed condition (step 128).

The raw speed signal captured by the speed detector can be subject to a variety of errors, the most typical being slipping of, for example, a tachometer employed as the speed detector. In order to reduce the impact of such errors on the system, the sensed speed can be combined with a sensed acceleration in such a way as to create a combined (filtered) speed that has an overall smaller error. The filtered speed can be calculated (step 126) using, for example, a proportional plus integral (PI) filter with the measured acceleration fed into the loop to adjust for error conditions including, for example, slippage of the speed detector.

The filtered speed can be calculated as a function of the sensed speed and the sensed acceleration (step 126) by initially multiplying a speed error by a gain to determine a proportional speed error. The speed error is also integrated, and the integrated speed error is multiplied by the gain to determine an integrated proportional speed error. The proportional speed error, the integrated proportional speed error, and the measured acceleration are summed to determine a filtered acceleration. The filtered acceleration is integrated to determine the filtered speed. The filtered speed calculation may be implemented in a continuous loop in which the speed error is equal to the sensed speed minus the filtered speed calculated by the controller in the previous cycle through the loop. The effect of the PI filtering is to make the acceleration information dominate at higher frequencies where the acceleration detector displays higher accuracy than the speed detector, and the speed information dominate at lower frequencies where the speed detector displays higher accuracy than the acceleration detector.

In some embodiments, the acceleration error and the speed error can be monitored during normal elevator operation to detect a failure in the speed or the acceleration detector. The acceleration error and the speed error can be put through a low pass filter and a detector error may be declared if the acceleration error or speed error exceeds a threshold error level.

In addition to calculating the filtered speed (step 126), method 120 includes comparing the filtered speed to a threshold speed to determine if the mass has reached an over-speed condition (step 128). An initial over-speed detection point typically occurs when the speed of the elevator mass exceeds an over-speed threshold that is commonly specified by industry code authorities. The drive and brake system are de-energized when the threshold over-speed is exceeded. However, if an over-speed condition is detected without additional conditions, the system will be sensitive to a variety of disturbances including, for example, people jumping in the car. In order to mitigate these disturbances, a variety of processing techniques may be used, including, for example, signaling an over-speed condition only when the speed of the mass exceeds the threshold speed for a continuous period of time ("over-speed period of time").

Figure 7:
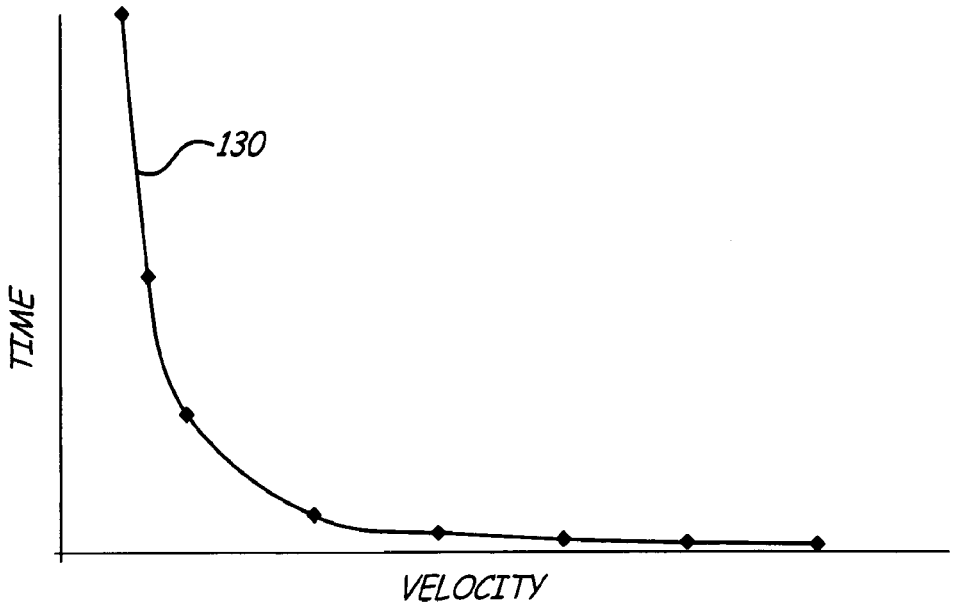
FIG. 7 is a graph of over-speed period of time plotted as a function of the difference between the filtered speed of an elevator mass and the threshold speed that initially signals an over-speed condition.

The over-speed period of time may be a fixed value including, for example, 1 second. Alternatively, the over-speed period of time may be calculated as a function of the amount that the filtered speed exceeds the threshold speed. For example, FIG. 7 is a graph of the over-speed period of time as a function of the difference between the filtered speed of the elevator mass and the threshold speed that initially signals a possible over-speed condition. Curve 130 in FIG. 7 represents one way to implement the additional condition of an over-speed time before signaling that the elevator mass is an over-speed condition. As shown in FIG. 7, over-speed time is exponentially inversely related to the amount that the filtered speed exceeds the threshold speed. Therefore, as the filtered speed of the elevator mass exceeds the threshold speed in increasing amounts, the over-speed time (i.e. the time the mass must stay at a speed above the threshold before signaling an over-speed condition) decreases exponentially. After comparing the filtered speed to a threshold speed to determine if the mass has reached an over-speed condition (step 128), which may include determining if the filtered speed of the mass is greater than the threshold for the over-speed time, method 120 can also include dropping the drive sheave mechanical brake.

As described above, in certain circumstances dropping the drive sheave brake will fail to stop the elevator mass, signaling a runaway condition. Method 120 therefore can include the step of releasing an electromechanical safety trigger to engage an elevator safety when the mass stays in the over-speed condition after the drive sheave mechanical brake has been dropped. The trip point at which a runaway condition is signaled can be a function of the speed $V_T$ at which the mass accelerating at a set rate A will take a set amount of time $T_s$ to reach a code required speed $V_c$ for applying the stopping force of the safeties. As an example, a 1 m/sec elevator accelerating at an acceleration of 0.26 g may travel from an initial over-speed threshold of 1.057 m/s to a code required speed $V_c$ of 1.43 m/s in 145 milliseconds. It requires 25 milliseconds to activate and engage the safeties. Therefore, the trip speed $V_T$=1.35 m/s, which is the speed at 120 milliseconds (145–25) from 1.057 m/s. This trip speed allows the necessary time (25 milliseconds) to activate the safeties before the code required speed is reached.

In addition to runaway conditions, a separate unsafe condition known as free fall must be accounted for in elevator safety systems. As the name implies, a free falling elevator system mass is falling unimpeded by any braking or safety activation. Mathematically, a free fall condition occurs when the mass is traveling down at 1 g. Because, a free falling mass is unencumbered by brakes or safeties, it will travel from the initial over-speed threshold to the point at which the safeties must start to apply a stopping force in a shorter period of time than a runaway. For example, a 1 m/sec elevator in free fall can travel from an over-speed threshold of 1.057 m/sec to the code required trip point in 45 milliseconds. If the elevator safety system uses the speed of the mass alone, the actuation of the safeties would have to start at a much lower speed, resulting in more false trips from non-safety related disturbances. Therefore a filtered acceleration qualified by speed may be used to remove disturbances and allow for a quicker reaction time.

Method 120 therefore can also include the steps of comparing a filtered acceleration to a threshold acceleration, and measuring how long the mass has been in the over-speed condition. The filtered acceleration is calculated as part of calculating the filtered speed of the mass (step 126) and is equal to the sum of the proportional speed error, the integrated proportional speed error, and the measured acceleration. In the event the filtered acceleration and the over-speed time exceed set thresholds, method 120 can also include dropping the drive sheave brake and engaging the elevator safety simultaneously. For example, the machine room brake and the safeties can be actuated if the filtered acceleration exceeds 0.5 g and the elevator mass is traveling down at a speed greater than the over-speed threshold continuously for 10 milliseconds. Requiring a relatively small continuous period of time over the speed threshold avoids tripping on impact conditions such as a person impacting the platform in a jump. Qualifying the acceleration with the speed information prevents trips during other events including, for example, emergency stops and buffer strikes.

Method 120 can also include filtering raw acceleration measurements at one or more frequencies in order to lessen the influence of external disturbances. Filtering the measured acceleration can include filtering the measured acceleration through one or more of a low pass filter and a bandstop filter in a range of hoistway resonances. For example, the measured acceleration can first be run through a low pass filter to remove high frequency disturbances. Next the acceleration can be run though a bandstop filter to remove the effects from non-safety related oscillations including, for example, people jumping in the car and system excitation during emergency stops. The goal of the bandstop filter is to lessen the effects of hoistway resonances, which can include, for example, 10 db cut off at frequencies 2.5 to 6 Hz.

Although the present invention has been described with reference to particular embodiments, workers skilled in the art will recognize that changes may be made in form and detail without departing from the scope of the invention as defined by the claims that follow.

The invention claimed is:

1. An elevator safety system comprising:

a speed detector configured to sense a speed of an elevator system mass;

an acceleration detector configured to sense an acceleration of the mass;

a mechanical safety configured to be connected to the mass;

an electromagnetic trigger connected to the safety; and a controller configured to release the trigger to engage the mechanical safety when (a) the speed detector senses an over-speed condition or (b) acceleration detector senses an over-acceleration condition for the mass, and to automatically reset the trigger;

wherein the trigger comprises a link to the mechanical safety, an actuator, and an electromagnet, wherein resetting the trigger includes activating the actuator to impart linear motion to the electromagnet in a first direction to bring the electromagnet in contact with the link and then activating the actuator to impart linear motion to the electromagnet in a second direction opposite the first direction to reset the trigger.

2. The system of claim 1, wherein the trigger can be released while the controller is resetting the actuator.

3. The system of claim 1, wherein the speed detector comprises a tachometer.

4. The system of claim 3, wherein the tachometer is configured to be driven by a sheave that rotates at a speed related to the speed of the mass.

5. The system of claim 4, wherein the sheave comprises an idler sheave connected to the mass.

6. The system of claim 3, wherein the tachometer is configured to be connected to the mass and driven by a static rope arranged adjacent the mass.

7. The system of claim 3, wherein the tachometer is configured to be connected to the mass and driven by a guide rail arranged adjacent the mass.

8. The system of claim 1, wherein the acceleration detector comprises an accelerometer.

9. The system of claim 8, wherein the accelerometer comprises a micro-electromechanical system.

10. The system of claim 8, wherein the accelerometer is configured to be connected to the mass.

11. The system of claim 1, wherein the elevator system mass is one of a car and a counterweight.

12. An elevator comprising:

a car;

a counterweight;

a drive machine;

a traction member connected between the car and the counterweight and driven by the drive machine; and a safety system comprising:

a speed detector configured to monitor a speed of one of the car and the counterweight;

an acceleration detector configured to monitor an acceleration of one of the car and the counterweight;

a mechanical safety connected to one of the car and the counterweight;

an electromagnetic trigger connected to the mechanical safety; and a controller configured to release the trigger to engage the mechanical safety when the speed detector signals an over-speed condition or the acceleration detector signals an over-acceleration condition for one of the car and the counterweight, and to automatically reset the trigger wherein the trigger comprises a link to the mechanical safety, an actuator, and an electromagnet, wherein resetting the trigger includes activating the actuator to impart linear motion to the electromagnet in a first direction to bring the electromagnet in contact with the link and then activating the actuator to impart linear motion to the electromagnet in a second direction opposite the first direction to reset the trigger.

13. The elevator of claim 12, wherein the trigger can be released while the controller is resetting the actuator.

14. The elevator of claim 12, wherein the speed detector comprises a tachometer.

15. The elevator of claim 14, wherein the tachometer is configured to be driven by a sheave that rotates at a speed related to the speed of the one of the car and the counterweight.

16. The elevator of claim 15, wherein the sheave comprises an idler sheave connected to the one of the car and the counterweight.

17. The elevator of claim 14, wherein the tachometer is configured to be connected to and driven by a static rope arranged adjacent the one of the car and the counterweight.

18. The elevator of claim 14, wherein the tachometer is configured to be connected to and driven by a guide rail arranged adjacent the one of the car and the counterweight.

19. The elevator of claim 12, wherein the acceleration detector comprises an accelerometer.

20. The elevator of claim 19, wherein the accelerometer comprises a micro-electromechanical system.

21. An elevator safety system comprising:

a speed detector configured to sense a speed of an elevator system mass;

an acceleration detector configured to sense an acceleration of the mass;

a mechanical safety configured to be connected to the mass;

an electromagnetic trigger connected to the safety; and a controller configured to release the trigger to engage the safety when (a) the speed detector senses an over-speed condition or (b) acceleration detector senses an over-acceleration condition for the mass, and to automatically reset the trigger;

wherein the electromagnetic trigger comprises an link, an actuator, an electromagnet and a spring;

wherein the link is kinematically connected to the mechanical safety;

wherein the electromagnet is connected to the actuator;

wherein when the electromagnet trigger is in a ready state, the spring is compressed and the electromagnet is magnetically connected to the link; and wherein when the electromagnetic trigger is in a release state, the spring is decompressed and the electromagnet is away from the link.

* * * * *